US010701787B2

(12) United States Patent
Liu et al.

(10) Patent No.: US 10,701,787 B2
(45) Date of Patent: Jun. 30, 2020

(54) X-RAY CONVERSION TARGET AND X-RAY GENERATOR

(71) Applicants: Nuctech Company Limited, Beijing (CN); Tsinghua University, Beijing (CN)

(72) Inventors: Yaohong Liu, Beijing (CN); Ziran Zhao, Beijing (CN); Jinsheng Liu, Beijing (CN); Huaibi Chen, Beijing (CN); Liang Zhang, Beijing (CN); Dongsheng Zhang, Beijing (CN)

(73) Assignees: Nuctech Company Limited, Beijing (CN); Tsinghua University, Beijing (CN)

( * ) Notice: Subject to any disclaimer, the term of this patent is extended or adjusted under 35 U.S.C. 154(b) by 65 days.

(21) Appl. No.: 16/117,267

(22) Filed: Aug. 30, 2018

(65) Prior Publication Data

US 2019/0090336 A1 Mar. 21, 2019

(30) Foreign Application Priority Data

Sep. 19, 2017 (CN) ..... 2017 1 0856486

(51) Int. Cl.

| | |
|---|---|
| ***H01J 35/10*** | (2006.01) |
| ***H05G 1/02*** | (2006.01) |
| ***H01J 35/12*** | (2006.01) |

(52) U.S. Cl.

CPC ..... *H05G 1/02* (2013.01); *H01J 35/12* (2013.01); *H05G 1/025* (2013.01); *H01J 2235/088* (2013.01); *H01J 2235/1283* (2013.01)

(58) Field of Classification Search

CPC ..... H05G 1/02; H01J 35/12; H01J 2235/088; H01J 2235/1283; H04G 1/025

See application file for complete search history.

(56) References Cited

U.S. PATENT DOCUMENTS

| | | | | |
|---|---|---|---|---|
| 2,090,636 | A | 8/1937 | Olshevsky | |
| 5,680,433 | A | 10/1997 | Jensen | |
| 7,186,022 | B2 * | 3/2007 | Charles, Jr. ..... | H01J 35/08 378/200 |

(Continued)

FOREIGN PATENT DOCUMENTS

| | | |
|---|---|---|
| CN | 203617244 U | 5/2014 |
| GB | 1 249 341 | 10/1971 |

(Continued)

OTHER PUBLICATIONS

Extended European Search Report for Application No. 18191113.2 dated Feb. 6, 2019, which corresponds in priority to above-identified subject U.S. Application.

(Continued)

*Primary Examiner* — Kiho Kim

(74) *Attorney, Agent, or Firm* — Knobbe, Martens, Olson & Bear, LLP

(57) ABSTRACT

The disclosed technology relates to an X-ray conversion target. In one aspect, the X-ray conversion target includes target body and a target part arranged within the target body, the target part having a first face configured to produce X-rays. The X-ray conversion target further comprises a cooling passage having a side wall, at least a part of the side wall being consisted of a portion of the target part.

13 Claims, 4 Drawing Sheets

(56) References Cited

U.S. PATENT DOCUMENTS 9,552,956 B2 1/2017 Yanagisawa et al.

FOREIGN PATENT DOCUMENTS

| | | | |
|---|---|---|---|
| JP | H 03230460 | A | 10/1991 |
| JP | 2003-230460 | A | 8/2003 |
| JP | 2013-122906 | A | 6/2013 |
| KR | 2014-0043146 | A | 4/2014 |

OTHER PUBLICATIONS

Examination Report for Australian Application No. 2018222941 dated Apr. 10, 2019, which corresponds in priority to above-identified subject U.S. Application.
Office Action Issued for Korean Application No. 10-2018-0103734 dated Oct. 7, 2019, which corresponds in priority to above-identified subject U.S. Application.
Office Action for Japanese Application No. 2018-161333 dated Jul. 9, 2019, which corresponds in priority to above-identified subject U.S. application.

* cited by examiner

X-RAY CONVERSION TARGET AND X-RAY GENERATOR

CROSS-REFERENCE TO RELATED APPLICATIONS

This application claims priority to Chinese Patent App. No. 201710856486.2, titled "X-RAY CONVERSION TARGET", which was filed on Sep. 19, 2017, and which is hereby incorporated by reference in its entirety.

BACKGROUND OF THE DISCLOSED TECHNOLOGY

Field of the Technology

The disclosed technology relates to the field of X-ray conversion, and in particular, to an X-ray conversion target and X-ray generator.

Description of the Related Technology

With continuous improvement of electron accelerator technologies, accelerators are widely being used for various applications in more and more industries. For example, high-energy electrons accelerated by the accelerator may be used to modify a product. Examples of using accelerators can include foods being irradiated and sterilized in the food industry, X-ray irradiation breeding, X-ray stimulated increase in production and X-ray irradiation for pest control in agriculture, and medical imaging and medical treatment being performed in medical industry.

For a high-power accelerator for irradiation, it is necessary to dissipate heat of a target material, otherwise the target material may be melted if the heat of the target material could not be removed rapidly. Meanwhile, heat dissipation effect directly influences a useful life of a conversion target and a work efficiency of an accelerating tube.

SUMMARY OF CERTAIN INVENTIVE ASPECTS

According to an aspect of the disclosed technology, there is provided an X-ray conversion target, comprising a target body and a target part disposed within the target body, the target part having a first face configured to produce X-rays;

wherein, the X-ray conversion target further comprises a cooling passage having a side wall, at least a part of the side wall being constituted by a portion of the target part.

In one embodiment, the cooling passage comprises a cooling groove located in a second face of the target part, the second face and the first face being two faces of the target part facing away from each other; and the cooling groove is defined by the second face together with a first ridge and a second ridge, which are arranged opposite to each other and extend along an edge of the second face of the target part respectively.

In one embodiment, the cooling passage comprises an annular groove provided in the target body at a side of the target part, provided within the target body.

In one embodiment, the X-ray conversion target further comprises a cooling lateral portion located at a side of the target part, the cooling lateral portion defining an interior space of the cooling lateral portion in which the X-rays produced by the target part propagate.

In one embodiment, the target body comprises a target body outer side portion defining an interior space of the target body; and the annular groove is defined by the target body outer side portion and the cooling lateral portion of the target part.

In one embodiment, the target body outer side portion and the cooling lateral portion of the target part are connected with each other by a connection part, which defines, together with the target body outer side portion and the cooling lateral portion of the target part, the annular groove; and the connection part comprises a fluid inlet adjacent to a first end of the target part and a fluid outlet adjacent to a second end of the target part opposite to the first end.

In one embodiment, a top face of the target body outer side portion is located in a same plane as top faces of the first ridge and the second ridge.

In one embodiment, the X-ray conversion target further comprises a cover plate arranged on the top face of the target body outer side portion and the top faces of the first ridge and the second ridge.

In one embodiment, the target part includes copper.

In one embodiment, the target part includes gold on a surface of the copper.

In one embodiment, the X-ray conversion target further comprises a passage support plate extending continuously from the target body outer side portion and defining an emission passage for the X-rays produced by the target part.

In one embodiment, the X-ray conversion target further comprises a passage support plate extending from the target body outer side portion and defining an emission passage for the X-rays produced by the target part.

In one embodiment, the X-ray conversion target further comprises support plate fins arranged on an outer side of the passage support plate and configured to dissipate heat from the passage support plate.

In one embodiment, the cooling lateral portion at the side of the target part, the first ridge and the second ridge are formed into a one-piece structure.

In one embodiment, the cooling lateral portion at the side of the target part, the first ridge, the second ridge and the target body outer side portion are formed into a one-piece structure.

In one embodiment, the first ridge and the second ridge each have a thickness greater than 5 mm, with respect to the second face.

According to an aspect of the disclosed technology, there is provided an X-ray generator comprising the above described X-ray conversion target.

In one embodiment, the X-ray generator includes an electron accelerator configured to provide accelerated electrons.

In one embodiment, the X-ray generator includes a coolant supply device configured to supply a coolant for circulation.

In one embodiment, the X-ray generator includes a heat sink configured to cool the coolant for circulation.

DETAILED DESCRIPTION OF CERTAIN ILLUSTRATIVE EMBODIMENTS

Figure 1:
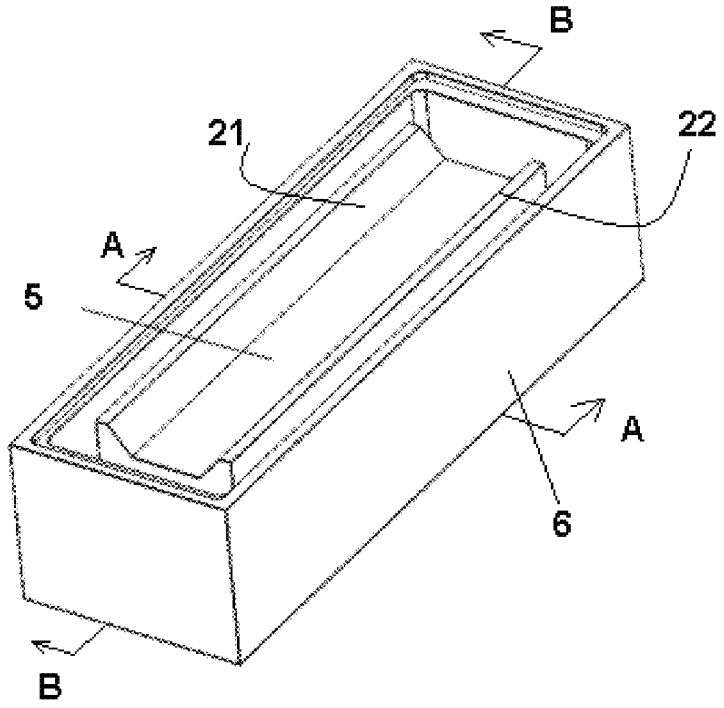
FIG. 1 is a perspective diagram of an X-ray conversion target of an embodiment of the disclosed technology, with a cover plate being removed.

Although various modification and alternatives may be made to the disclosed technology, exemplary embodiments of the disclosed technology will be illustrated for example in the drawings and will be described in detail herein. It will be understood, however, that the accompanying drawings and the detailed description are not intended to limit the disclosed technology to specific forms disclosed, rather, are intended to cover all modifications, equivalents and alternatives falling with spirit and scope of the disclosed technology defined in appended claims. The drawings are only schematic and thus may not be drawn to scale.

Embodiments of the disclosed technology will be described with reference to the drawings.

As shown in FIG. 1-5, an embodiment of the disclosed technology provides an X-ray conversion target, comprising a target body and a target part 5 disposed within the target body. The target part 5 has a first face configured to produce X-rays. The X-ray conversion target further comprises a cooling passage having a side wall, at least a part of the side wall being constituted by a portion of the target part 5.

In a working state, a high-energy electron beam is perpendicularly incident to the first face of the target part 5, so that the target part 5, which may be formed by, for example, a copper material, produces X-rays, while parts of high-energy electrons become back bombardment electrons. The first face may be a substantially planar surface. Bombardment of the high-energy electrons causes an increased temperature of the target part 5. A portion of the target part 5 constitutes the side wall of the cooling passage such that heat generated by the target part 5 may be directly transferred to the cooling passage and carried away by fluid in the cooling passage, thereby the temperature of the target part 5 will not quickly rise. The fluid in the cooling passage may be a liquid, for example, water having a large specific heat. Since the copper has a good heat conductivity, the heat generated by the target part 5 may be quickly transferred to a cooling medium in the cooling passage.

Figure 3:
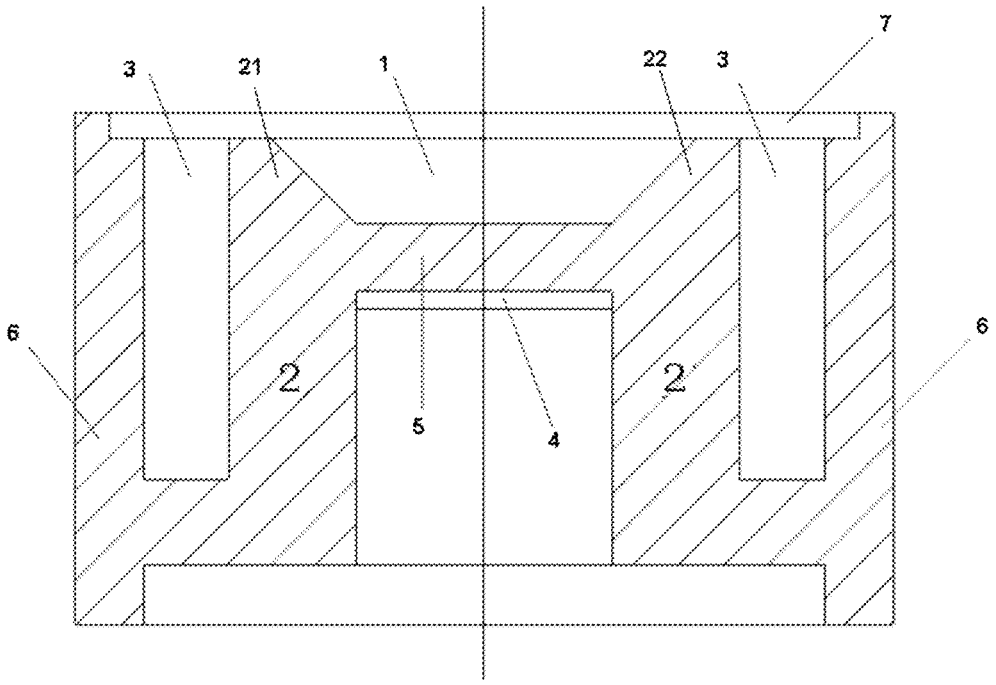
FIG. 3 is a cross sectional diagram of an X-ray conversion target of an embodiment of the disclosed technology, taken along a line A-A in FIG. 1, with a passage support plate being removed.
Figure 4:
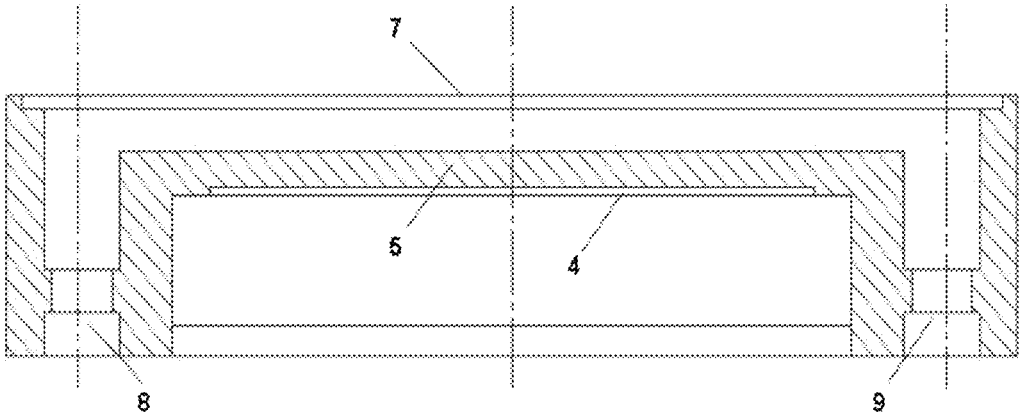
FIG. 4 is a cross sectional diagram of an X-ray conversion target of an embodiment of the disclosed technology, taken along a line B-B in FIG. 1, with a passage support plate being removed.

In one embodiment of the disclosed technology, as shown in FIG. 3, the cooling passage comprises a cooling groove 1 located in a second face of the target part 5, the second face and the first face being two faces of the target part 5 facing away from each other. When a cooling medium passes through the cooling groove 1, the second face of the target part 5 is in direct contact with the cooling medium, so that a part of the heat of the target part 5 is taken away by the cooling medium and the temperature of the second face of the target part 5 decays. As such, a temperature difference is established between the first face and the second face of the target part 5, such that the heat of the target part 5 is quickly transferred from the first face to the second face of the target part 5, thereby suppressing increase of the temperature of the first face of the target part 5. The target part may have a length of about 134 mm and a width of about 48 mm, and the cooling groove 1 may be arranged at back of the target part 5, thereby providing a more compact structure and facilitating design and mounting of an external shield. The target part may have a length of any value that can be designed as required.

In one embodiment, the cooling groove 1 is defined by the second face together with a first ridge 21 and a second ridge 22, which are arranged opposite to each other and extend along an edge of the second face of the target part 5 respectively. In the embodiment shown in FIG. 3, a cross section of the cooling groove 1 has an inverted trapezoid shape. However, the cross section of the cooling groove 1 may also have a rectangular shape or other shape. The first ridge 21 and the second ridge 22 are arranged opposite to each other, and in FIG. 3, a height of their top face relative to the second face, or a depth of the cooling groove 1, may be 4 mm, or may be 5 mm, or may be any value ranged from 4 mm to 5 mm. However, the depth of the cooling groove 1 may be greater than 5 mm. In general, water is used as the cooling medium because water has a larger specific heat and use of water is economical. If temperature of a local region of the target part 5, for example, the first face, becomes high due to bombardment of the high-energy electron beam, the water in contact with the target part 5 will be locally vaporized and boil to form air gaps, which will greatly attenuate heat dissipation effect. If the depth of the cooling groove 1 exceeds 4 mm, or even 5 mm, obstruction of heat dissipation by the air gaps due to local vaporizing may be effectively prevented. In this embodiment, the first ridge 21 and the second ridge 22 themselves, which are each formed of a copper material, have a good heat dissipation ability. In one embodiment, the first ridge 21 and the second ridge 22 may be formed integrally with the target part 5.

In another embodiment, a third ridge, a four ridge or more ridges may be provided on the second face, as heat dissipation elements, for increasing contact area of the second face of the target part 5 with the cooling medium to improve heat dissipation ability.

In one embodiment, the cooling passage further comprises an annular groove 3 located at a side of the target part 5 and around the target part 5.

In one embodiment, the X-ray conversion target further comprises a cooling lateral portion 2 located at a side of the target part 5, and the cooling lateral portion 2 defines an interior space of the cooling lateral portion 2, in which the X-rays produced by the target part 5 propagates. In other words, an extending direction of the cooling lateral portion 2 is substantially the same as an emitting direction of the X-rays produced by the target part 5, and is opposite to a movement direction of the high-energy electron beam bombarding towards the target part 5. The movement direction of the high-energy electron beam is generally indicated by an arrow 10 in FIG. 5.

In one embodiment, the cooling lateral portion 2 at the side of the target part 5, the first ridge 21 and the second ridge 22 are formed into a one-piece structure. The one-piece structure is advantageous in that heat generated by the target part 5 may be quickly transferred to a low-temperature region of the target part 5.

In one embodiment, the target body comprises a target body outer side portion 6 defining an interior space of the target body. The target body outer side portion 6 together with the cooling lateral portion 2 of the target part 5 defines the annular groove 3. In other words, the target body outer side portion 6 forms an outer portion of the annular groove 3, while the cooling lateral portion 2 of the target part 5 forms an inner portion of the annular groove 3, and the annular groove 3 is formed between the target body outer side portion 6 and the cooling lateral portion 2 of the target part 5. A cooling medium may flow in the annular groove 3 so as to bring away heat of the cooling lateral portion 2 of the target part 5, thereby reducing temperature of the cooling lateral portion 2 of the target part 5.

In one embodiment, the cooling lateral portion 2 at the side of the target part 5, the first ridge 21, the second ridge 22 and the target body outer side portion 6 are formed into a one-piece structure. The one-piece structure is advantageous in that heat generated by the target part 5 may be quickly transferred to a low temperature region of the target part 5.

In one embodiment, a top face of the target body outer side portion 6 is located in a same plane as top faces of the first ridge 21 and the second ridge 22. The X-ray conversion target may further comprise a cover plate 7 arranged on the top faces of the target body outer side portion 6 and the top faces of the first ridge 21 and the second ridge 22.

In this embodiment, when the cover plate 7 covers the top faces of the target body outer side portion 6 and the top faces of the first ridge 21 and the second ridge 22, it will be understood that since the top face of the target body outer side portion 6 is located in the same plane as the top faces of the first ridge 21 and the second ridge 22, the cooling groove 1 located between the first ridge 21 and the second ridge 22 are separated from the annular groove 3 by the first ridge 21 and the second ridge 22, while the annular groove 3 is divided into two parts by the first ridge 21 and the second ridge 22. For example, and as shown in FIG. 3, the annular groove 3 is divided into a left part of the annular groove 3 and a right part of the annular groove 3. It is noted that the separation described here for the cooling groove 1 from the annular groove 3 means that the cooling medium could not flow from the annular groove 3, through the top face of the target body outer side portion 6 and the top faces of the first ridge 21 and the second ridge 22, into the cooling groove 1.

The target body outer side portion 6 and the cooling lateral portion 2 of the target part 5 are connected with each other by a connection part, which defines, together with the target body outer side portion 6 and the cooling lateral portion 2 of the target part 5, the annular groove 3. In this case, as shown in FIG. 3, the annular groove 3 is formed by the cover plate 7 located at an upper side, the connection part located at a lower side, the target body outer side portion 6 located at an outer side and the cooling lateral portion 2 of the target part 5 located at a middle position. Herein, orientation terms such as upper, lower and the like are described with respect to the figures, and are intended to illuminate relative positional relationships among respective parts. In other cases, for example, the target body may be reversed, so that in this situation, the cover plate 7 is located at a lower side while the connection part is located at an upper side.

Figure 2:
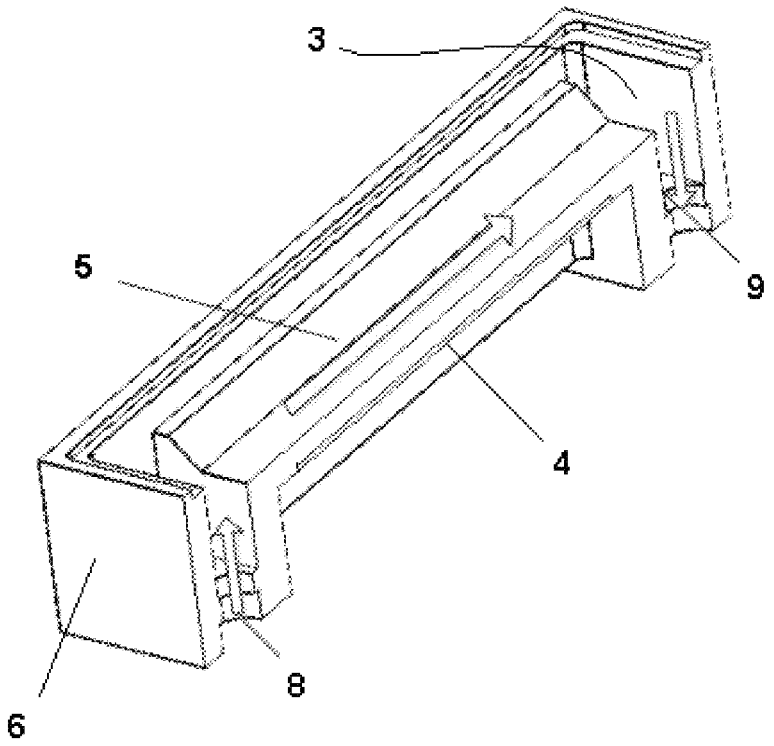
FIG. 2 is a perspective diagram of a half of an X-ray conversion target of an embodiment of the disclosed technology, with a cover plate being removed.

In this embodiment, the connection part comprises a fluid inlet 8 adjacent to a first end of the target part 5 and a fluid outlet 9 adjacent to a second end of the target part 5 opposite to the first end. A cooling medium such as water flows into the annular groove 3 through the fluid inlet 8. Referring to FIG. 2, since the top face of the target body outer side portion 6 and the top faces of the first ridge 21 and the second ridge 22 are located in the same plane and are in contact with the cover plate 7, when the water flows in a direction indicated by the arrow shown in FIG. 2, a part of the water flows into the cooling groove 1 and flows out from the fluid outlet 9 in a direction indicated by a middle arrow shown in FIG. 2, another part of the water flows to a left side of the annular groove 3, through the left side of the annular groove 3, and out of the fluid outlet 9, and a further part of the water flows to a right side of the annular groove 3, through the right side of the annular groove 3, and out of the fluid outlet 9. In this embodiment, due to arrangement of the first ridge 21 and the second ridge 22, the cooling medium is divided into three streams respectively flowing through the cooling passage; further, the first ridge 21 and the second ridge 22 may be used as radiating fins; meanwhile, since the fluid is divided into a plurality of streams, a flow velocity of the fluid is increased, thereby improving cooling effect of the cooling medium. In this embodiment, the cooling medium is in direct contact with the second face (or also called as a back face) of the target part 5, such that a large amount of heat generated by the first face of the target part 5 due to bombardment from the high-energy electron beam is transferred to the cooling medium in the cooling passage, avoiding quick increasing of the temperature of the target part 5. The cooling lateral portion 2 of the target part 5 may be formed integrally with the target part 5, such that the heat of the target part 5 may be quickly transferred to the cooling lateral portion 2 of the target part 5, and the cooling lateral portion 2 is in direct contact with the cooling medium, thereby providing a more cooling support for the target part 5.

In another embodiment of the disclosed technology, the second face of the target part 5 is further provided with a third ridge and even a fourth ridge, thereby providing a further heat dissipation part in contact with the cooling medium. A top face of the third ridge or more ridges may be not located in a same plane as the top face of the first ridge 21. A plurality of ridges may be used as radiating fins to improve heat dissipation ability.

In one embodiment, the top face of the third ridge or more ridges may be located in a same plane as the top faces of the first ridge 21 and the second ridge 22. In such a case, the cooling groove 1 is divided into a plurality of sub cooling grooves 1, thereby not only arrangement of a plurality of ridges may improve heat dissipation effect, but also the cooling effect may be greatly improved due to the following fact: a cross sectional area of the cooling groove 1 is reduced (occupied by the plurality of ridges), thus a flow velocity of the cooling medium will be increased for a constant flow rate of the cooling medium, and a contact area of the ridges with the cooling medium is further increased, that is, an indirect contact area of the target part 5 with the cooling medium is increased. For this case, it is important that the target part 5 is made of a heat conductive material such as copper, because the copper can transfer heat generated by the target part 5 to its back face (second face) quickly, and also to the cooling lateral portion 2 of the target part 5.

In one embodiment, gold is provided on a surface of the target part 5. For example, a gold layer 4 is provided on a surface of a copper target part 5 so as to form a composite target part 5, which is advantageous because the composite target part 5 may ensure obtaining a higher dosage rate of production of X-rays under a high-energy electron beam of a constant energy. For example, a portion of the target part 5 generating the X-rays may be, for example, a composite target formed by covering a gold layer 4 having a thickness of 1 mm on an oxygen-free copper having a thickness of 4 mm. This composite target can provide a larger dosage rate of production of X-rays. This composite target has a length of 80 mm, which length may cooperate with a scanning magnet to generate stripe-shaped X-rays, thereby satisfying different requirements for shape of the X-rays.

Figure 5:
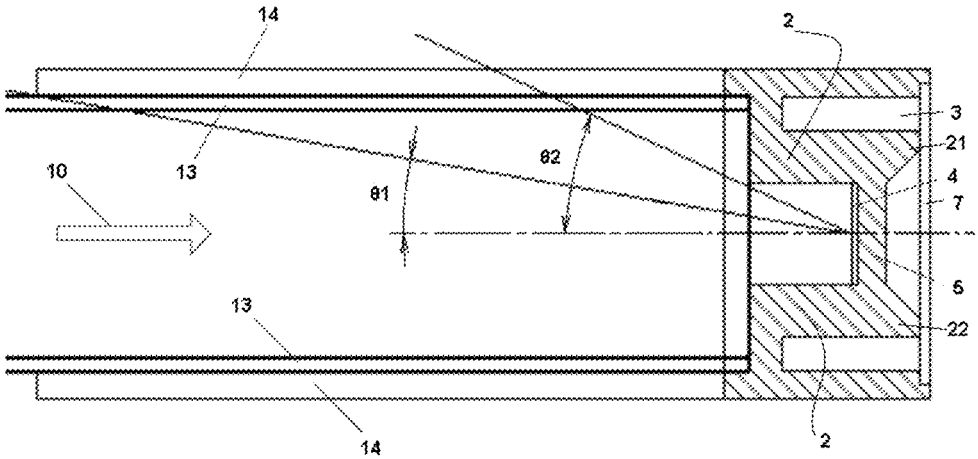
FIG. 5 is a schematic cross sectional diagram of an X-ray conversion target of an embodiment of the disclosed technology, taken along the line A-A in FIG. 1.

In this embodiment, the cooling lateral portion 2 of the target part 5 defines the interior space of the cooling lateral portion 2, so that when the target part 5 is bombarded by the high-energy electron beam, X-rays generated by the target part 5 propagates within the interior space of the cooling lateral portion 2, while some high-energy electrons form back-bombardment electrons which are reflected to go away from the target part 5. FIG. 5 shows a distribution of back-bombardment electrons in a state of bombardment of a high-energy electron beam to the target part 5. In FIG. 5, θ1 may be 15°, θ2 may be 25°, the back-bombardment electrons occupies 90% in regions from 10° to 25° and more than 25°, and the back-bombardment electrons in the region more than 25° are absorbed by the cooling lateral portion 2 of the target part 5. The cooling lateral portion 2 of the target part 5 will increase in temperature due to absorbing the back-bombardment electrons. Since the cooling lateral portion 2 constitutes the side wall of annular groove 3 to be in direct contact with the cooling medium, the cooling medium in the annular groove 3 may bring away heat of the cooling lateral portion 2 quickly, so that temperature of the cooling lateral portion 2 may be effectively controlled. A thickness of the cooling lateral portion 2 of the target part 5 may be, for example, 7 mm, 7.5 mm, 8 mm or the like, such that the cooling lateral portion 2 can effectively block parts of the back-bombardment electrons while effectively taking away heat generated by the target part 5.

In one embodiment of the disclosed technology, a thickness of the outer side portion of the target body may be, for example, 4 mm, a thickness of the cover plate 7 may be, for example, 1.5 mm, and the cover plate 7 may be a stainless steel plate. The cover plate 7 may function to fix and seal the target.

In one embodiment of the disclosed technology, as shown in FIG. 5, the X-ray conversion target further comprises a passage support plate 13 defining an emission passage for the X-rays produced by the target part 5. The passage support plate 13 may extend continuously from the target body outer side portion 6. The passage support plate 13 may be formed of a stainless steel plate. The passage support plate 13 may not only prevent scattering of X-rays, but also avoid person from damage caused due to scattering of a part of back-bombardment electrons to outside. The temperature of the passage support plate 13 will rise due to bombardment of the back-bombardment electrons. In one embodiment of the disclosed technology, the X-ray conversion target further comprises support plate fins 14, and the support plate fins 14 are arranged on an outer side of the passage support plate 13 and configured to dissipate heat from the passage support plate 13. In one embodiment, the passage support plate 13 and the support plate fins 14 arranged on the outer side of the passage support plate 1 may be sized to cover the region between 10°~25° shown in FIG. 5. The support plate fins 14 may be formed from a copper plate.

During actual operation, when the high-energy electron beam bombards the target part 5, the cooling medium, for example water, is injected through the fluid inlet 8, and is discharged from the fluid outlet 9, so that the temperature of the target part 5 may be controlled in a better way. An injection amount of the cooling medium may be determined based on energy of the high-energy electron beam.

Embodiments of the disclosed technology further provide an X-ray generator. The X-ray generator may include the above described X-ray conversion target. The X-ray generator may further include an electron accelerator configured to provide accelerated electrons. The X-ray generator may further include a coolant supply device configured to supply a coolant for circulation. In order to cool the coolant that is heated during circulation, the X-ray generator may further include a heat sink configured to cool the coolant for circulation.

Although various exemplary embodiments according to the general concepts of the disclosed technology have been shown and described, it would be appreciated by those skilled in the art that various changes or modifications can be made in these embodiments without departing from the principles and spirit of the disclosure, the scope of which is defined in the claims and their equivalents.

What is claimed is:

1. An X-ray conversion target, comprising a target body and a target part disposed within the target body, the target part having a first face configured to produce X-rays;

wherein, the X-ray conversion target further comprises a cooling passage having a side wall, at least a part of the side wall being constituted by a portion of the target part;

wherein, the cooling passage comprises a cooling groove located in a second face of the target part, the second face and the first face being two faces of the target part facing away from each other; and the cooling groove is defined by the second face together with a first ridge and a second ridge, which are arranged opposite to each other and extend along an edge of the second face of the target part respectively;

wherein, the cooling passage comprises an annular groove provided in the target body at a side of the target part provided within the target body.

2. The X-ray conversion target according to claim 1, further comprising a cooling lateral portion located at a side of the target part, the cooling lateral portion defining an interior space of the cooling lateral portion in which the X-rays produced by the target part propagate.

3. The X-ray conversion target according to claim 2, wherein, the target body comprises a target body outer side portion defining an interior space of the target body; and the annular groove is defined by the target body outer side portion and the cooling lateral portion of the target part.

4. The X-ray conversion target according to claim 3, wherein, the target body outer side portion and the cooling lateral portion of the target part are connected with each other by a connection part, which defines, together with the target body outer side portion and the cooling lateral portion of the target part, the annular groove; and the connection part comprises a fluid inlet adjacent to a first end of the target part and a fluid outlet adjacent to a second end of the target part, opposite to the first end.

5. The X-ray conversion target according to claim 4, wherein, a top face of the target body outer side portion is located in a same plane as top faces of the first ridge and the second ridge.

6. The X-ray conversion target according to claim 5, further comprising a cover plate arranged on the top face of the target body outer side portion and the top faces of the first ridge and the second ridge.

7. The X-ray conversion target according to claim 3, further comprising a passage support plate extending continuously from the target body outer side portion and defining an emission passage for the X-rays produced by the target part.

8. The X-ray conversion target according to claim 2, wherein the cooling lateral portion at the side of the target part, the first ridge and the second ridge are formed into a one-piece structure.

9. The X-ray conversion target according to claim 1, wherein the target part includes copper.

10. The X-ray conversion target according to claim 9, wherein the target part includes gold on a surface of the copper.

11. The X-ray conversion target according to claim 1, further comprising a passage support plate defining an emission passage for the X-rays produced by the target part.

12. The X-ray conversion target according to claim 11, further comprising support plate fins arranged on an outer side of the passage support plate and configured to dissipate heat from the passage support plate.

13. The X-ray conversion target according to claim 1, wherein the first ridge and the second ridge each have a thickness greater than 5 mm, with respect to the second face.

* * * * *